United States Patent [19]

Fischer

[11] 4,145,104

[45] Mar. 20, 1979

[54] PLUG CONNECTION

[76] Inventor: Heinz Fischer, Weserstr. 114, Langwedel-Daverden, Fed. Rep. of Germany

[21] Appl. No.: 774,641

[22] Filed: Mar. 7, 1977

[51] Int. Cl.[2] ..... H01R 13/62

[52] U.S. Cl. ..... 339/65; 339/178

[58] Field of Search ..... 339/65, 66, 89, 178, 339/179, 188–190

[56] References Cited

U.S. PATENT DOCUMENTS

| | | | |
|---|---|---|---|
| 1,425,049 | 8/1922 | Peterson | 339/186 R |
| 2,239,787 | 4/1941 | Kakes | 339/178 |
| 2,606,224 | 8/1952 | Modrey | 339/89 R |

FOREIGN PATENT DOCUMENTS

| | | | |
|---|---|---|---|
| 130666 | 1/1951 | Sweden | 339/41 |

*Primary Examiner*—Neil Abrams

*Attorney, Agent, or Firm*—Charles Hieken

[57] ABSTRACT

A plug and socket connection includes helical guides at the socket for guiding mating helical pins on the plug through orifices to connection contacts protected by the orifices in the socket. The projection of each helical guide about the socket axis subtends an angle that is substantially equal to 360° divided by the number of helical guides.

7 Claims, 13 Drawing Figures

FIG. 1
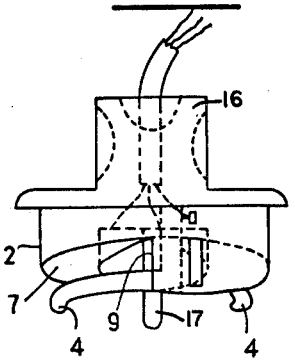
FIG. 4
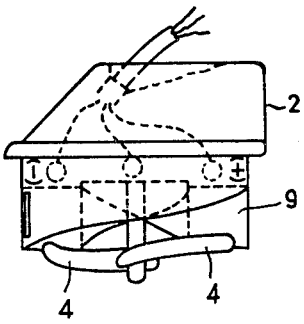
FIG. 8
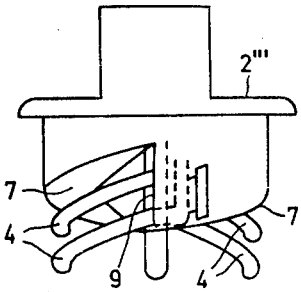
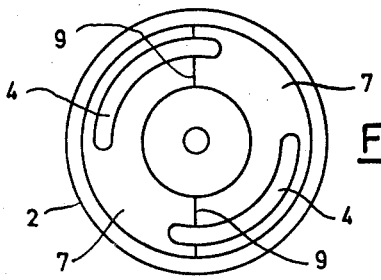
FIG. 3
FIG. 7
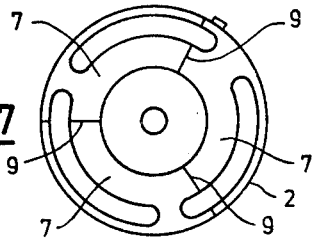
FIG. 2
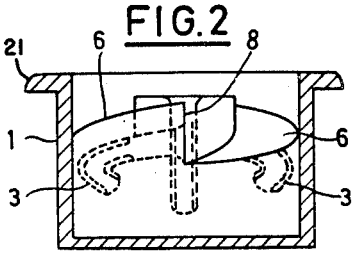
FIG. 6
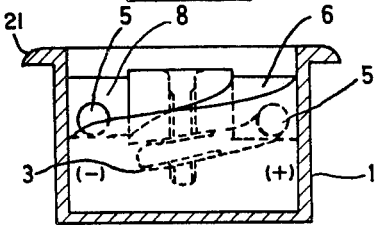
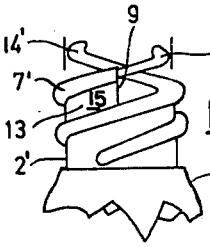
FIG. 10
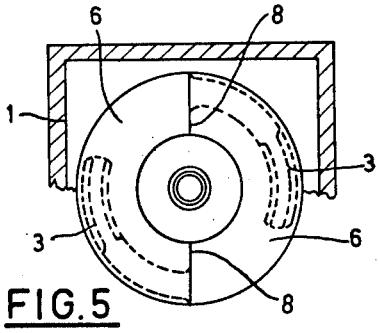
FIG. 5
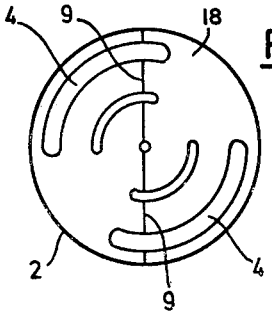
FIG. 9
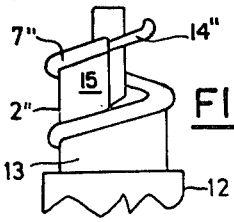
FIG. 11
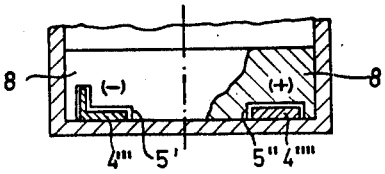
FIG. 12
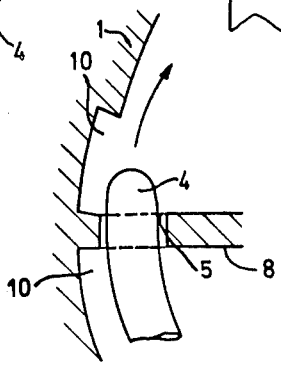
FIG. 13

PLUG CONNECTION

BACKGROUND OF THE INVENTION

The invention relates to a plug connection consisting of two connectable plug contact holders, namely a plug or other lead-in-holder of lead-in contacts, and a socket or other connection holder including connection contacts which are protected against accidental contact behind orifices, for the insertion of said lead-in contacts.

The plug connections known hitherto are unsatisfying because of (a) the necessity to search the orifices for leading in the plug contacts, which search procedure is especially a handicap for physically disabled persons, (b) unreliability of protection against accidental contacts, and (c) bad splashproof.

SUMMARY OF THE INVENTION

The above disadvantages may be avoided by that helical guides are provided at the socket or other connection holder for leading-in the pins or other lead-in contacts through the orifices to the contact-protected connection contacts. Thus the contacts of the plug may be engaged easily by a simple rotation of the plug. Furthermore the security against accidents and also splashproof is highly increased.

Numerous other features, objects and advantages of the invention will become apparent from the following specification when read in connection with the accompanying drawing in which:

BRIEF DESCRIPTION OF THE DRAWING

FIG. 1 is a diametrical sectional view of a two-pin plug,

FIG. 2 is a side view of the corresponding socket,

FIG. 3 is an axial view of the two-pin plug in FIG. 1,

FIG. 4 is a side view of FIG. 1,

FIG. 5 is a top view of FIG. 2,

FIG. 6 is a side view of FIG. 2 with a square section through the casing, FIG. 7 is an axial view of a three-pin plug, FIG. 8 is a side view of a four-pin plug, FIG. 9 is an axial view like FIG. 3 of an embodiment with helical protective plugs, FIG. 10 is a partial side view of a filament lamp showing the base, FIG. 11 is a partial side view of another filament lamp showing the base, FIG. 12 is a sectional view of non-reversible plug contacts and corresponding socket-orifices, and FIG. 13 is in a larger scale a partial sectional view through one of the orifices and a lead-in contact.

DETAILED DESCRIPTION OF PREFERRED EMBODIMENTS

The embodiment shown in FIGS. 1 to 6 relates to a plug connection consisting of a socket 1 holding two connection contacts 3 in socket 1 in the form of pin bushings and a two-pin plug 2 holding two lead-in contacts 4 in the form of helical pins, engaging said pin bushings 3 after insertion through orifices 5.

Both contact holders, socket 1 and plug 2, are provided at their confronting front sides with helical guides 6 in socket 1 and 7 in plug 2, respectively, for leading in said helical pins 4 of plug 2 by simple clockwise rotation of the plug body after having put the plug into the bowllike socket 1, the rim 21 of which is above the uppermost portion of said helical guides 6. Each helical guide extends over 180° in the two-pin and four-pin-embodiments of FIGS. 1 to 6, 8 and 9 and over 120° in the three-pin-embodiment of FIG. 7. Thereby each helical guide 6 of the socket 1 with its low, clockwise fore end abuts the high beginning of the adjacent helical guide 6 the back side of which forming an axial wall 8 including said orifices 5. These walls 8 simultaneously serve as stops for the lead-in-motion of the plug 2 with its contacts 4. Furthermore each helical guide 7 of the plug 2 with its clockwise fore end abuts the beginning of the adjacent helical guide 7 the back side of which forming an axial wall 9. Each of these walls 9 is carrying one (FIGS. 1 - 6, 7) or two (FIG. 8) of said helical pins 4, which in their stop position engage the pin bushings 3 lying beneath or behind the helical guides 6 thus well protected against accidental contact.

As is shown in FIG. 13, the insertion of needles or wires by children may be made even more difficult by forming catches 10, preferably behind the orifices 5 at the side of the path of the entering pins 4, so that such needles or wires will be guided and retained to avoid their insertion through the orifices 5. Especially when positioned at the circumference of said helical path the catches will give a good barrier. Also said walls 8 will stop needles and wires because the orifices 5 are spaced from the inner wall of socket 1.

The invention may also be useful for the improvement of security against accidents in filament lamps 11 with their plug adapters 12 and in cut-out units 13 with their contact part 14 as is shown in FIGS. 10 and 11. In these embodiments the helical guides or coils 7', 7'' are not arranged at the front sides but at the cylindrical outside 15 of the lead-in holder 2'' and the cylindrical inside of the connection holder, which latter is not shown in the drawing.

Protective plugs may be provided, as for instance a central protective plug 16 engaging a central bushing contact 17 (FIGS. 1 to 8 and 11) or helical protective plugs 18 (FIG. 9). Preferably said helical pins 4 are arranged in such a manner, that they will form together with said guides 7 (consisting of isolating material) continuous helical guide or runner and will glide over the helical guides 6 of the socket 1.

FIG. 12 is a diametrical sectional view through a portion of a socket illustrating how the invention may be arranged for receiving polarized plugs. Contact 4''' is of L-shaped cross section embraced by a correspondingly shaped cross section for orifice 5'. Contact 4'''' is of rectangular cross section opposite an orifice 5'' of corresponding cross section. Thus this embodiment is capable of receiving either a polarized or non-polarized plug because a plug having non-polarized contacts both of rectangular cross section may still pass through orifices 5' and 5'' to engage contacts 4''' and 4''''.

In the drawing the same reference symbols have been used to identify corresponding elements throughout the figures, occasionally adding one or more primes to differentiate between corresponding elements in different embodiments when convenient.

Of course, all contacts 3,4,16,17,18 and contacts not shown in the drawing are provided or connected to terminals within the socket 1 and plug 2, respectively.

There has been described a novel plug connection characterized by improved use with easy insertion from an angular position whatever and high security against accidents and splash. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed.

LIST OF REFERENCES

1,2 — plug connection consisting of two connectable plug contact holders
1 — holder of connection contacts, socket or connection holder
2 — holder of the lead-in contacts 4, two-pin plug or lead-in holder
2' — plug adapter or terminal holder of filament lamp 11
2'' — terminal holder of cut-out unit 13
3 — connection contacts of 1; pin-bushings for reception of pins 4
4,4' — lead-in contacts of 2,2', 2''; pins
5,5' — orifices of 1 for 4,4'
6 — helical guides at 1 for 2,4
7 — helical guides at 2
8 — axial walls, stops at 1
7' — helical coil at 2'
7'' — helical coil at 2''
9 — axial walls at 2
10 — catches
11 — filament lamp
12 — cut-out unit
13 — cylindrical outside
16 — central protective plug
17 — central bushing contact for 16
18 — helical protective plugs

What I claim is:

1. In a plug connection consisting of two connectable plug contact holders, namely a plug or other lead-in holder with lead-in contacts, and a socket or other connection holder including connection contacts which are protected against accidental contact behind orifices for the insertion of said lead-in contacts, the improvement comprising means defining at least two angularly spaced socket helical guides of insulating material and a socket axial limiting surface at the socket or other connection holder for leading-in the pins or other lead-in contacts through the orifices to the contact-protected connection socket contacts, the projection of each helical guide subtending an angle about the socket axis that is substantially equal to 360° divided by the number of said helical guides, a corresponding plurality of angularly spaced plug helical guides of insulating material and plug helical contacts at the plug for mating relationship with said first-mentioned socket helical guides and socket contacts respectively and a plug axial limiting surface coacting with the socket axial limiting surface for limiting angular relative movement between the plug and socket as the plug is mated with the socket.

2. Plug connection in accordance with claim 1, wherein said axial limiting surfaces are formed by the front sides of the helical guides of the connection holder, said orifices being in said front sides.

3. Plug connection in accordance with claim 1 wherein said helical guides are arranged at the front sides of said two contact holders.

4. Plug connection in accordance with claim 1 wherein the lead-in contacts are made from striplike flat material.

5. Plug connection in accordance with claim 4 wherein the lead-in contacts and orifices within the connection holder are made so that they are usable for reversible as well as for non-reversible plug contacts.

6. Plug connection in accordance with claim 1 wherein said plug contacts are non-reversible.

7. Plug connection in accordance with claim 1 and further comprising an arrangement of catches for needles or wires at the side of the path of the lead-in contacts.

* * * * *